United States Patent [19]

Boutarin

[11] Patent Number: 4,592,179

[45] Date of Patent: Jun. 3, 1986

[54] INSULATED WALL PANELS

[76] Inventor: Jacques Boutarin, 4 rue de Sarda, 26200 Montelimar, France

[21] Appl. No.: 497,242

[22] Filed: May 23, 1983

[51] Int. Cl.[4] ..... E06B 7/12

[52] U.S. Cl. ..... 52/172; 52/209; 52/304; 52/745; 156/109

[58] Field of Search ..... 52/171, 172, 173 R, 52/202, 203, 209, 302, 303, 304, 588, 589, 788, 789, 790, 791, 745; 156/109, 262

[56] References Cited

U.S. PATENT DOCUMENTS

| | | | |
|---|---|---|---|
| 2,756,467 | 7/1956 | Etling | 52/304 |
| 2,886,864 | 5/1959 | Boicey et al. | 52/304 |
| 2,966,435 | 12/1960 | Kassinger | 156/109 |
| 3,161,265 | 12/1964 | Matsch et al. | 52/303 |
| 3,167,159 | 1/1965 | Bovenkerk | 52/303 |
| 3,570,201 | 3/1971 | Barroero | 52/304 |
| 3,733,237 | 5/1973 | Wolff | 156/109 |
| 3,735,553 | 5/1973 | Houser | 52/304 |
| 4,255,907 | 3/1981 | Lightell | 52/202 |
| 4,423,577 | 1/1984 | Larguia | 52/171 |

*Primary Examiner*—John E. Murtagh
*Assistant Examiner*—Andrew Joseph Rudy
*Attorney, Agent, or Firm*—Eric P. Schellin

[57] ABSTRACT

The present invention is directed to a method making an insulated wall panel, used in glazing, having two plates that define an internal space. In one of the plates a hole is drilled to form a receiving aperture into which a permeable capsule is inserted. The permeable capsule releases excess vapors from the internal space with unidirectional effect. The panel can then be mounted in situ and the permeable capsule is left in place to provide for the ongoing evacuation of excess vapors from the internal space.

10 Claims, 5 Drawing Figures

INSULATED WALL PANELS

BACKGROUND OF THE INVENTION

1. Field of the Invention

The present invention relates to a method for manufacturing and mounting multiwall insulating panels used for the glazing of buildings, and to the panels thus manufactured. The panels are made with at least two plates or walls secured or connected at their periphery either directly by welding or with an intermediate metallic spacer or with one or more sealing products or cements, or also by using assembled profiled sections forming a frame.

2. Description of the Prior Art

The object of the invention has been the improvement of the conditions for the evacuation of the excess of vapors such as water, solvent, oil vapors . . . the origins of which are varied (changes caused by the cleaning products, the paints, the wood treatments, . . . ). These vapors are formed in the internal space between the walls or plates. A pressure in crease is caused in the internal space by these vapor formations, with such defects as considerations, the effects of which are troublesome and/or destructive, for instance: by impairing the vision through the transparent panes or plates; by creating "thermal bridges" between the plates, the heat insulating capacity being thus reduced; by deteriorating or damaging the seals, the profiled frame, the securing planes, the cementing etc.

The vapors formed withint the internal space generate a tension which it is important to evacuate in order to prevent the aforesaid troublesome or destructive effects. It will be obvious that this evacuation must take place as directly and as quickly as possible.

SUMMARY

For this purpose, and in accordance with the invention, a plate or panel is drilled or cut out, generally but not exclusively on the side of the atmosphere, externally, and at the prepared location or locations a permeable capsule or patch is secured. The capsule or patch permits an evacuation, with unidirectional effect, of the excess of vapors in tension within the internal space between the plates.

In accordance with further characteristics: the capsule is flexible and tightly sealed; the capsule is interchangeable and the capsule is provided within the entire thickness thereof with a micro-perforated patch.

These and other characteristics will be apparent from the following description.

BACKGROUND OF THE INVENTION

To make the object of the invention more concrete, without however restricting it thereby, in the attached drawing.

DETAILED DESCRIPTION

Various forms of embodiment of the invention will be described now with reference to the Figures of the drawings, which are not limitative as to the possibilities of application and embodiment.

The panel is denoted generally by reference number (1), and this panel is comprised of a frame (2) which is generally U-shaped, and within which the insulating plates (3–4) can be engaged, and these plates may be made of transparent, translucent or opaque glass, or of any other transparent, traslucent or opaque material.

In accordance with the invention, in order to obtain a unidirectional evacuation towards the exterior, one bore **(3*a*) at least is drilled in the plate (3) for receiving a capsule denoted generally by reference number (11)**.

This capsule is formed entirely of or in part of, any material having the physical and/or chemical properties permitting an evacuation of the vapors in excess which originate a tension in the internal space (A). This tension promoting the evacuation or transfer.

Figure 1:
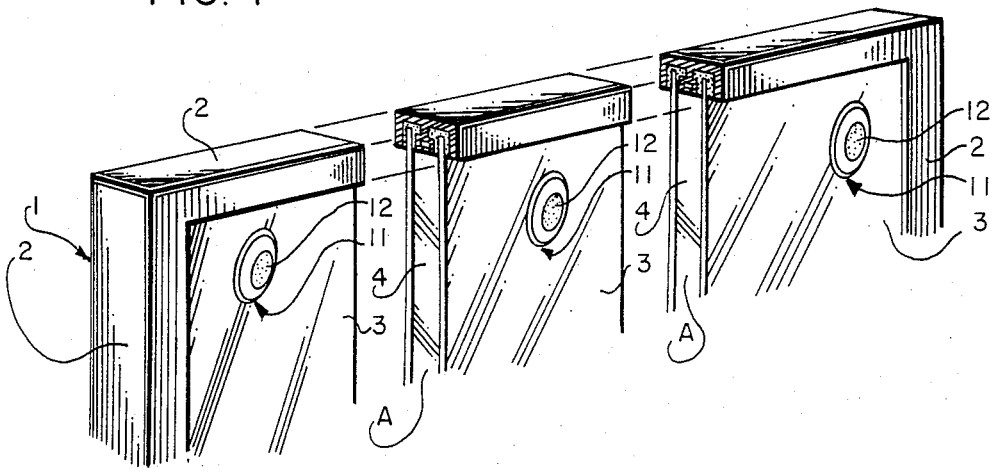
FIG. 1 illustrates in a general perspective view, and by way of example, the upper portion of a panel in accordance with the invention, provided with a plurality of capsules for the evacuation of the vapors in excess.
Figure 2:
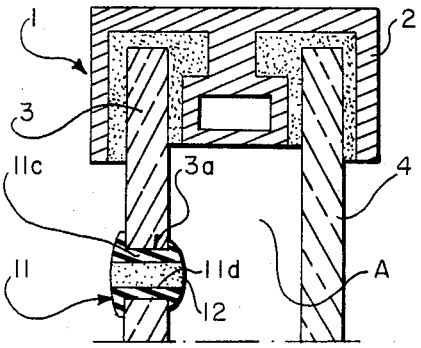
FIGS. 2 and 3 are sectional views in part, on a larger scale, of a panel, these views showing different capsules for the evacuation of the vapors in excess, with which the panels may be provided.
Figure 4:
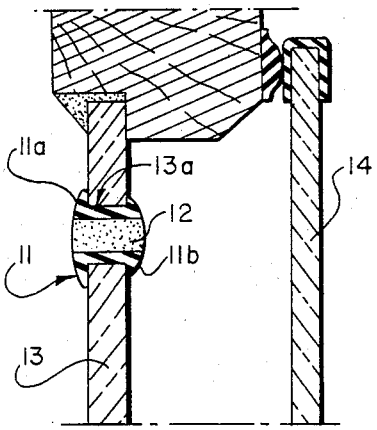
FIG. 4 illustrates a capsule for a double glazing plate, in the case where a pane or plate is adapted to fit in a removable or opening manner with an existing woodwork or an existing folding panel.
Figure 5:
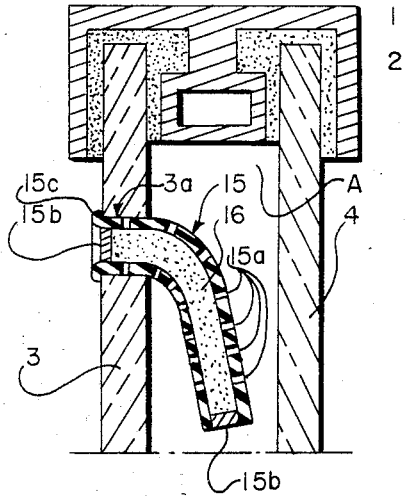
FIG. 5 illustrates the provisional equipment of a panel prior to the final positioning of the capsule, with a means obturating the bore for the capsule, said means containing an absorbing or dewatering product.

In accordance with a form of embodiment illustrated in FIGS. 2 and 4, the capsule (11) is of a flexible material capable of ensuring a watertight sealing, for instance any rubber or elastomeric material, or silicone.

Preferably, there is provided a form of embodiment according to which the capsule (11) is formed with a stop collar **(11*a*) against the plate (3), while a circular lip (11*b*) which is deformable permits the engagement across the bore (3*a*) while retaining then the capsule on the plate (3) when the capsule is adapted. The capsule can be pulled out in case of a voluntary effort sufficient for this purpose in order to remove the capsule from the plate. Between the collar (11*a*) and the lip (11*b*) is formed a bearing face (11*c*) engaged by pressure within the bore (3*a*). It will be obvious that taking into account the dimension of the bore (3*a*) and the thickness of the plate (3), the capsule is to be made with dimensions which will be such as to permit the collar, the circular lip and the bearing face to rest with pressure against the plate (3)** and to provide thus a reliable watertight sealing.

The shaping of the collar **(11*a*) in a curved manner or with a bevelled edge prevents the tearing off or the damaging of the capsule, during the cleaning of the plate (3)** for instance.

In accordance with the form of embodiment illustrated in FIGS. 2 and 4, the capsule (11) is open therethrough at **(11*d*) and a patch (12)**, for instance of sintered glass, is adapted in a forced and watertight manner therein for the evacuation or transfer of the vapors in excess and tensioned within the space (A). Instead of sintered glass, it is possible to use any other well known material or substance having similar properties and producing the same effect.

Figure 3:
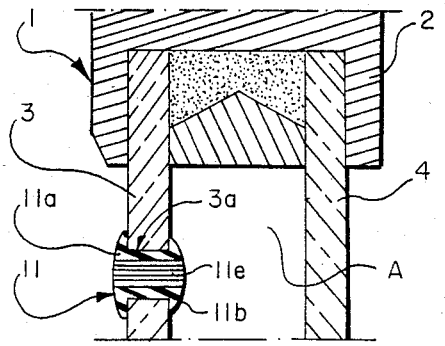

In accordance with the form of embodiment illustrated in FIG. 3, the capsule (11) is made entirely of silicone, and is micro-perforated according to any well known method in a portion of its section and therethrough at **(11*d*). The micro-perforations permit the evacuation or transfer of the vapors in excess and tensioned within the space (A). The capsule (11)** may be made of a material other than silicone, and may be made for instance of plastics pertaining to the polyamid or superpolyamid groups known under the registered trademark "NYLON", of molded acrylic material or other plastics having the necessary qualities of flexibility, tightness and strength, while being capable of a micro-perforation.

The dimensions of the capsules are preferably, but not exclusively, as reduced as possible, the reduced dimensions being selected for reasons of a more attractive appearance. As many capsules as necessary are provided. Preferably, but not exclusively, the capsules are adapted and secured in the upper portion of the glazed panels or similar. The capsules are thus not easy to reach, they are better protected, without interfering with the sight when the panels concerned are transparent panels. It is also possible to adapt and secure the capsules in the angles or on the edges of the glazed panels, and the capsules may also have corresponding various shapes.

Should there happen to be an accidental destruction or loss of a capsule, or should the capsules lose their efficiency on the long run, it will be easy to change them immediately, without difficulty.

The capsules can be mounted either directly when the panels are being manufactured, or it is also possible to adapt them "in situ" on panels or existing double glazings of windows and doors. In FIG. 4 for instance, a capsule (11) may be seen which is adapted on the pane or transparent plate (13) secured within the frame, a detachable and opening plate or pane (14) being applied and secured against the frame in order to form the insulating internal space.

When the panels are manufactured and are to be stored and forwarded prior to being installed, it is contemplated to proceed as described hereafter, both for obturating the bores (3*a*–13*a*) and for preventing an alteration of the capsules during the various storing, forwarding and mounting operations, and also in order to decrease the hygrometry of the internal space prior to the installation, so as to prevent a sudden and interfering condensation when the capsule or capsules is or are placed on the installed panel.

A flexible tube (15) or equivalent means is used. The tube or equivalent means being provided with a plurality of perforations (15*a*) and having more or less the dimension of the bore (3*a*) into which it can be engaged in a forced and watertight manner. This tube is filled with an adsorbing or de-watering product (16) which is well known and currently available on the market. The tube is obturated by lids (15*b*) at the two ends thereof, so that the product will be retained thereby. The flexible tube (15) is inserted frictionally within the internal space (A), and the outer end of the tube (15*c*) is flared up or bent back so that the tube will be retained and prevented from being inserted entirely within the space (A). The bore (3*a*) is obturated in a watertight manner and the adsorbing or de-watering product plays its part within the space (A). When the panel is positioned, the tube (15) is removed, and the capsule (11) is positioned without any troublesome effect. The capsules (11) may be offered within a box or protective packing containing one or more capsules.

It will be noted that in the case of capsule positioned "in situ", in accordance with FIG. 4 for instance, it is possible, after drilling of the bore (3*a*), to place a tube (15) with adsorbing product for a certain duration (24 hours for instance) prior to adapting the capsule, in order to achieve the aforementioned results.

The interest and the advantages of the arrangements in accordance with the invention will be clearly apparent from the description, an evacuation of the troublesome vapors in excess being provided thereby in a more direct, quicker and very efficient manner.

I claim:

1. Method for manufacturing and mounting multiwall insulating panels that form an internal space, the multiwall insulating panels are more particularly used for glazing of buildings, comprising cutting a portion of at least one plate of the panel on an external side, securing a permeable capsule (11) in the cut out portion, said capsule having unidirectional means for evacuating with unidirectional effect vapors, in excess, under tension within the internal space (A) between the panels; and mounting the multiwall panel in situ so that the capsule will evacuate with unidirectional effect excess vapors in the internal space.

2. A capsule (11) according to claim 1, which comprises any material having properties permitting an unidirectional evacuation of the vapors in excess originating within the internal space of the panel.

3. A capsule (11) according to either claim 1 or 2, which is of a flexible material appropriate to provide a sealing.

4. A capsule (11) according to either claim 1 or 2, which is entirely of a flexible material, appropriate to provide sealing and strength, said capsule being micro-perforated (11*e*) within a portion of the section thereof.

5. A capsule according to either claim 1 or 2, which is opened therethrough within a portion of the section thereof to receive a patch (12) more particularly of any material permitting the evacuation or transfer of the vapors in excess under tension within the internal space (A) of the panel.

6. A capsule according to either 1 or 2, characterized in that said capsule is interchangeable and has a stop collar (11*a*), a bearing face (11*c*) for engagement within the bore, and a deformable circular lip (11*b*) for retaining the capsule against the internal face of the plate (3), with dimensions permitting a forced engagement with watertight pressure against said plate.

7. A capsule according to claim 6, characterized in that the stop collar (11*a*) is contoured so as to prevent the tearing off or the damaging of the capsule.

8. A method according to claim 1, characterized in that at least one capsule is secured and adapted as well on pre-fabricated panels as "in situ" on panels already positioned in an opening.

9. A method according to claim 1, characterized in that a flexible tube (15) or equivalent means is used, which has perforations (15*a*) and is obturated at the ends (15*b*) thereof, and contains an adsorbing or dewatering product (16), said tube (15) being inserted frictionally within the bore (3*a*) drilled for the capsule, there being provided preferably a retaining arrangement (15*c*) to prevent the tube from being passed entirely into the internal space, the product of the tube being left to act for the necessary time, for instance until the panel will be positioned, the tube being then removed and the capsule (11) positioned.

10. A tube (15) according to claim 9, said tube containing an adsorbing or equivalent means, and being adapted to be retained frictionally and removed as desired from the perforation or aperture provided within the panel.

* * * * *